US011572666B2

(12) United States Patent
Klein

(10) Patent No.: US 11,572,666 B2
(45) Date of Patent: Feb. 7, 2023

(54) EASILY TRANSPORTED AND ASSEMBLED MODULAR BARRIER

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 731 days.

(21) Appl. No.: 16/461,620

(22) PCT Filed: Nov. 16, 2017

(86) PCT No.: PCT/IL2017/051250

§ 371 (c)(1),
(2) Date: May 16, 2019

(87) PCT Pub. No.: WO2018/092134

PCT Pub. Date: May 24, 2018

(65) Prior Publication Data

US 2020/0063387 A1 Feb. 27, 2020

Related U.S. Application Data

(60) Provisional application No. 62/423,220, filed on Nov. 17, 2016.

(51) Int. Cl.
*E01F 13/12* (2006.01)

(52) U.S. Cl.
CPC ..... *E01F 13/12* (2013.01)

(58) Field of Classification Search
CPC . E01F 15/00; E01F 15/10; E01F 15/14; E01F 13/00; E01F 13/04; E01F 13/12; E01F 13/02
See application file for complete search history.

(56) References Cited

U.S. PATENT DOCUMENTS

| | | | | |
|---|---|---|---|---|
| 3,057,601 | A * | 10/1962 | De | E01F 13/02 256/64 |
| 6,702,512 | B1 * | 3/2004 | Reale | E01F 13/123 404/6 |
| 7,918,622 | B2 | 4/2011 | Whitford | |
| 8,215,866 | B2 * | 7/2012 | Whitford | F41H 5/14 404/9 |
| 10,370,808 | B2 * | 8/2019 | Neusch | E01F 13/12 |
| 10,415,198 | B1 * | 9/2019 | Thomas | E01F 13/12 |
| 10,508,393 | B1 * | 12/2019 | Page | E01F 13/12 |

(Continued)

FOREIGN PATENT DOCUMENTS

| | | | | |
|---|---|---|---|---|
| CN | 106351146 A | * | 1/2017 | E01F 13/12 |
| CN | 106996087 A | * | 8/2017 | |

(Continued)

*Primary Examiner* — Jonathan P Masinick
(74) *Attorney, Agent, or Firm* — William H. Dippert; Laurence A. Greenberg; Werner H. Stemer

(57) ABSTRACT

Building blocks are provided to be aligned so as to build a modular barrier to stop objects that are moving on a ground. Each building block comprises connecting bracket having at least two receiving pockets, at least one of which is laterally directed and at least another is directed in a predetermined angle, and plurality of poles configured to be received within the receiving pockets so that some of the poles are substantially parallel to the ground while the others are configured to be received within the receiving pockets that are directed in the predetermined angle so as to allow the modular barrier to stop the moving objects.

21 Claims, 14 Drawing Sheets

(56) References Cited

U.S. PATENT DOCUMENTS

| | | | | |
|---|---|---|---|---|
| 10,724,191 | B2 * | 7/2020 | Pan | G05D 1/0011 |
| 10,738,426 | B2 * | 8/2020 | Messelis | E01F 13/06 |
| 11,149,391 | B2 * | 10/2021 | Weissberg | E01F 13/12 |
| 11,313,088 | B2 * | 4/2022 | Klein | E01F 13/02 |
| 2012/0177439 | A1 | 7/2012 | More et al. | |
| 2017/0204575 | A1 * | 7/2017 | Klein | E06B 11/027 |
| 2020/0173121 | A1 * | 6/2020 | Klein | E01F 13/12 |
| 2020/0393219 | A1 * | 12/2020 | Downing | F41H 11/08 |

FOREIGN PATENT DOCUMENTS

| | | | | |
|---|---|---|---|---|
| DE | 202018103084 | U1 * | 10/2018 | E01F 13/12 |
| FR | 3071856 | A1 * | 4/2019 | E01F 13/12 |
| FR | 3082532 | A1 * | 12/2019 | |
| FR | 3084379 | A1 * | 1/2020 | E01F 13/12 |
| GB | 2178094 | A * | 2/1987 | E01F 13/12 |
| JP | 4461330 | B2 | 5/2010 | |
| KR | 20100010544 | U * | 10/2010 | |
| WO | 2016030886 | A1 | 3/2016 | |

* cited by examiner

EASILY TRANSPORTED AND ASSEMBLED MODULAR BARRIER

CROSS-REFERENCE TO RELATED APPLICATIONS

The present application is a National Phase filing under 35 U.S.C. § 371 of International Patent Application No. PCT/IL2017/051250, filed Nov. 16, 2017, which is based upon and claims the benefit of the priority date of U.S. Provisional Patent Application Ser. No. 62/423,220, filed Nov. 17, 2016, each of which is expressly incorporated herein by reference in its entirety.

TECHNICAL FIELD

The present disclosed subject matter relates to heavy load modular vehicle barriers. More particularly, the present disclosed subject matter relates to portable barriers for easy and rapid transportation and assembly or disassembly.

BACKGROUND

Road barriers are used to block roads for the purpose of hostile vehicle and crowd mitigation as well as controlling vehicular transportation. Control over roads is a security measure that is essential especially in the last decades. It is a necessity to have better control over roads barriers that can be transported and assembled in an easy and fast manner.

SUMMARY

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

It is provided, in accordance with an exemplary embodiment, a building block to be aligned with other building blocks to build a modular barrier to stops objects that are moving on a ground, wherein the building block comprising:

connecting bracket having at least two receiving pockets wherein at least one of said at least two receiving pockets is laterally directed and at least one of said at least two receiving pockets is directed in a predetermined angle relative to the at least one of the receiving pockets that is laterally directed;

a plurality of poles, wherein at least one of the poles is configured to be received within the at least one of the receiving pockets that is laterally directed so that the poles are substantially parallel to the ground and wherein at least one of the poles is configured to be received within one of the at least two receiving pockets that are directed in the predetermined angle so as to allow the modular barrier to stop the objects.

Furthermore, in accordance with another exemplary embodiment, the building block is further comprising a plurality of connecting elements capable of connecting two adjacent building blocks.

Furthermore, in accordance with another exemplary embodiment, at least one of the plurality of connecting elements is provided to each pole or to the connecting bracket.

Furthermore, in accordance with another exemplary embodiment, the poles or the connecting bracket are provided with flanges configured to be connected to the connecting elements.

Furthermore, in accordance with another exemplary embodiment, one of said at least two receiving pockets is directed in the predetermined angle and at least two receiving pockets are laterally directed.

Furthermore, in accordance with another exemplary embodiment, said at least two receiving pockets that are laterally directed are two receiving pockets.

Furthermore, in accordance with another exemplary embodiment, the two receiving pockets are apart from each other by about 20-90 degrees and are positioned on the same plane.

Furthermore, in accordance with another exemplary embodiment, two of said at least two receiving pockets are directed in the predetermined angle and two receiving pockets are laterally directed.

Furthermore, in accordance with another exemplary embodiment, said at least two receiving pockets are two receiving pockets.

Furthermore, in accordance with another exemplary embodiment, the predetermined angle is more than 60°.

Furthermore, in accordance with another exemplary embodiment, the predetermined angle is 110°±10°.

Furthermore, in accordance with another exemplary embodiment, the pole has a rhombus profile.

Furthermore, in accordance with another exemplary embodiment, the receiving pockets has a rhombus profile.

Furthermore, in accordance with another exemplary embodiment, the rhombus profile of the receiving pocket that is laterally directed is oriented so that the pole received within the pocket has its corner side directed upwardly.

Furthermore, in accordance with another exemplary embodiment, the connecting bracket is provided with at least one pointing element that provides a thrust point.

Furthermore, in accordance with another exemplary embodiment, the pole is provided with spikes at a free end that is not to be received within the receiving pocket.

Furthermore, in accordance with another exemplary embodiment, a wheel is connected to the pole wherein the wheel has two states, a collapse state when weight is implemented onto the pole, and an active state when the modular barrier is to be moved.

Furthermore, in accordance with another exemplary embodiment, the connecting elements are bars that are positioned substantially perpendicular to the poles.

A modular barrier is provided in accordance with yet another preferred embodiment that comprises at least two building blocks as disclosed herein before, wherein adjacent building blocks are connected to each other.

Furthermore, in accordance with another exemplary embodiment, the modular barrier is further comprising a jack provided with wheels wherein the jack has two states, a first state in which the modular barrier is uploaded onto the wheels of the jack and a second state in which the wheels of the jack are neutralized.

Furthermore, in accordance with another exemplary embodiment, the transition between the first state and the second state is controlled by a lever.

Furthermore, in accordance with another exemplary embodiment, the jack pass through corresponding holes in the connecting brackets that are aligned and the wheels of the jack are provided between adjacent connecting brackets.

Furthermore, in accordance with another exemplary embodiment, adjacent connecting brackets in the modular barrier are organized so that the receiving pockets are all directed to the same directions.

A method to modularly build the barrier is comprising:

aligning a plurality of connecting brackets one by the other in a predetermined direction;

inserting and connecting the plurality of poles to within corresponding receiving pockets so as to form a plurality of basic units;

connecting the basic units one to the other.

Furthermore, in accordance with another exemplary embodiment, the method further comprising connecting the jack to the barrier so that the wheels of the jack are provided between adjacent basic units.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

In the drawings.

DETAILED DESCRIPTION

Figure 1A:
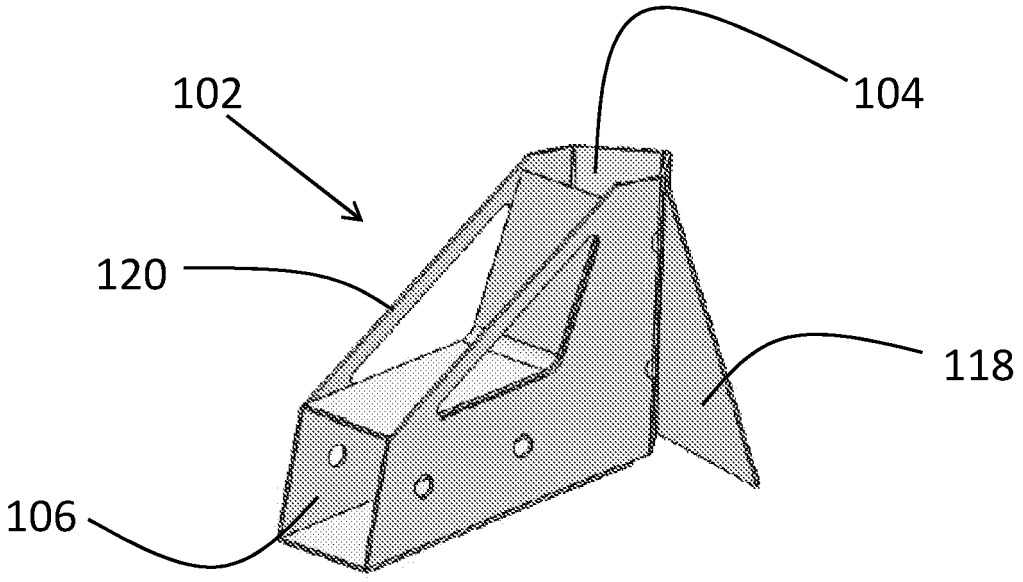
FIG. 1*a* illustrates a connector of a modular barrier, in accordance with some exemplary embodiments of the disclosed subject matter.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

It should be mentioned that the term "connector", "bracket", and "connecting bracket" are used alternately for the same element having the same functionality in the following text.

Figure 1B:
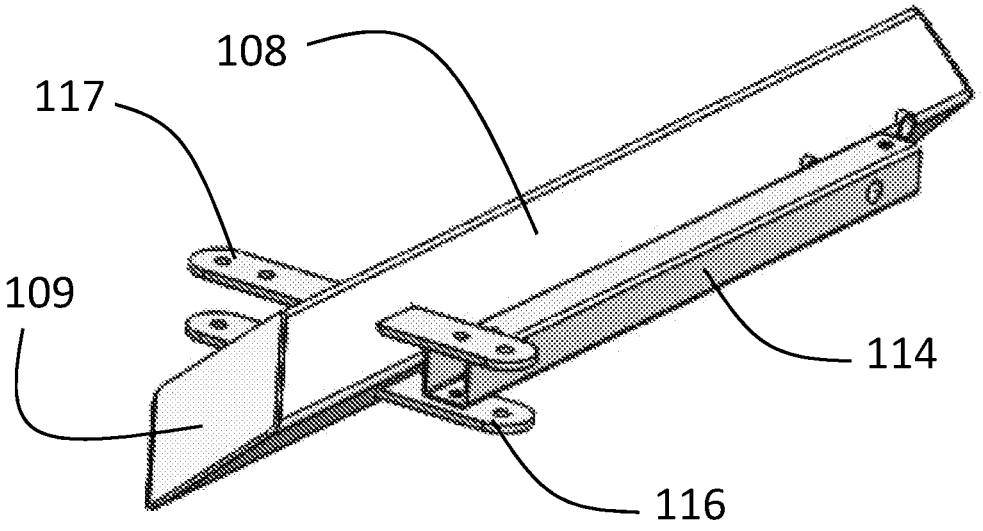
FIG. 1*b* illustrates a pole of a modular barrier, in accordance with some exemplary embodiments of the disclosed subject matter.
Figure 1C:
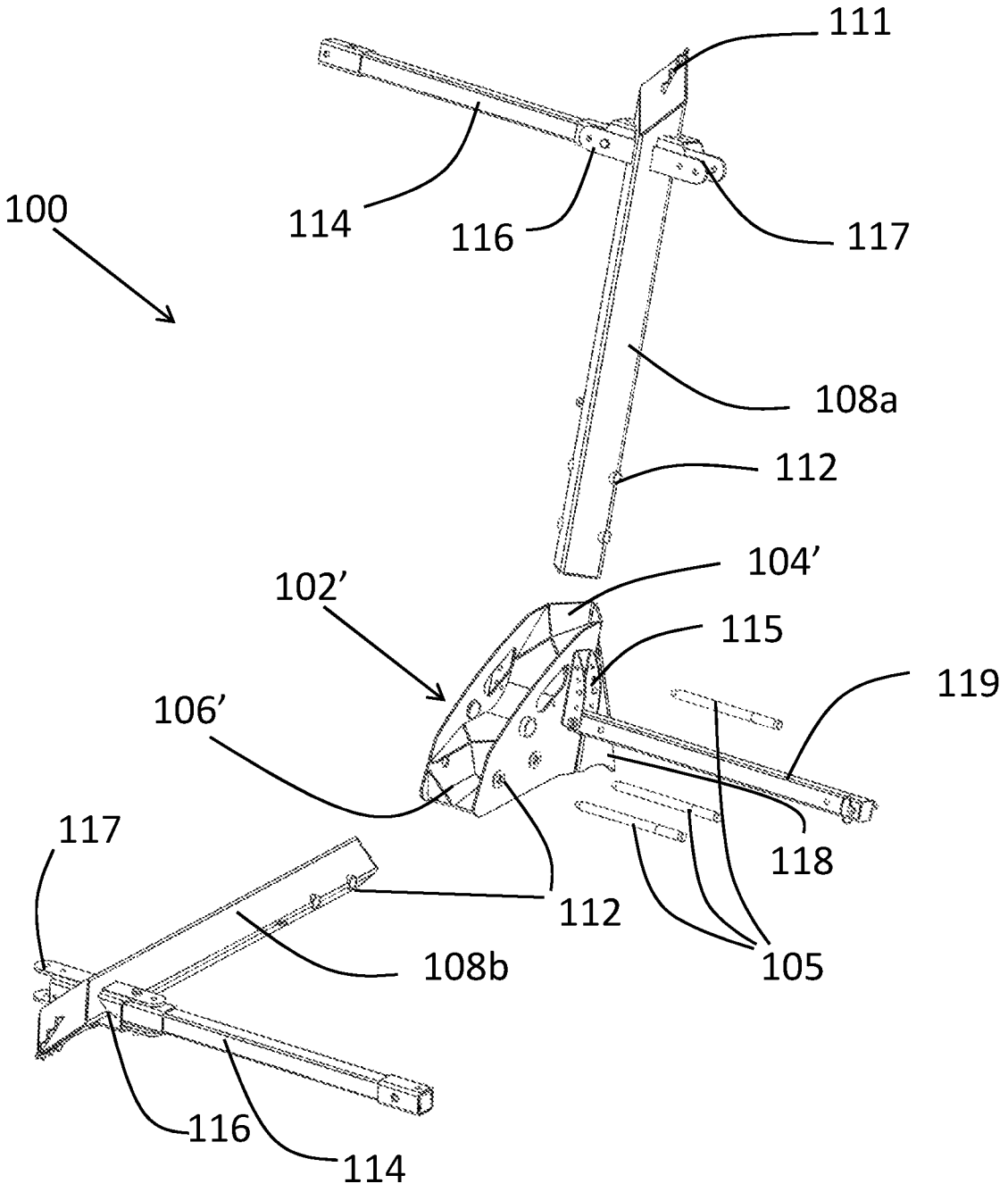
FIG. 1*c* illustrates an exploded view of a connecting bracket and two poles that form a basic unit of a modular barrier, in accordance with another exemplary embodiment of the disclosed subject matter.

Referring now to FIGS. 1*a-c* illustrating the connector and the poles, which are the building blocks of the modular barrier, and an exploded view of a connector and two poles that form a basic unit of a modular barrier, respectively, in accordance with exemplary embodiments of the disclosed subject matter. A basic unit 100 of the modular barrier as shown in FIG. 1*c* in a disassembled state is made of three essential building blocks, two of the building blocks are preferably identical or substantially similar, a fact that makes the transportation and assembly of the barrier to be cost effective, rapid, and simple since only two building blocks are distinguishable. Therefore and preferable, two building blocks are provided—a connector 102 (shown in FIG. 1*a*) that is preferably made of a bent tube of hard metal or several pieces of the hard metal welded together or connected together in any type of attachment as known in the art, to establish at least two but in this case two receiving pockets 104 and 106 that are configured to receive poles that will be, when inserted into the receiving pockets, angled in a predetermined angle that is more than 60° and preferably more than 90°. The second building block is a pole 108 that is shown in FIG. 1*b*. Pole 108 has a profile that can be substantially square, triangular, or rectangular so as to render stability and strength to it; however, a rhombus profile is the preferable profile as will be explained herein after. Other profiles are possible without limiting the scope of the subject matter. Pole 108 can be a hollow pole or a solid pole, depending on the demand and needed strength. It is preferable that a free end 109 of pole 108 (the end of the pole that is not received within the receiving pocket) is diagonally cut and covered with a diagonal surface. As mentioned herein before, the preferred profile of the pole 108 is rhombus while it's preferable orientation on the ground is with a corner directed upwardly.

Reference is now made specifically to FIG. 1*c* illustrating an exploded view of a connector and two poles that form a basic unit 100 of a modular barrier, in accordance with another exemplary embodiment of the disclosed subject matter. Basic Unit 100 comprises a connecting bracket 102' that is preferably made of hasped metal plates of steel that is provided with two pockets 104' and 106' preferably having rhombus profile. Poles 108*a* and 108*b* are provided with a profile that is designed to correspond and be received within the pockets 104' and 106' of connecting bracket 102' and are preferably made of the same material as the connecting bracket. One end of the two poles, 108*a* and 108*b*, is inserted within the corresponding pockets 104' and 106', respectively.

Figure 1D:
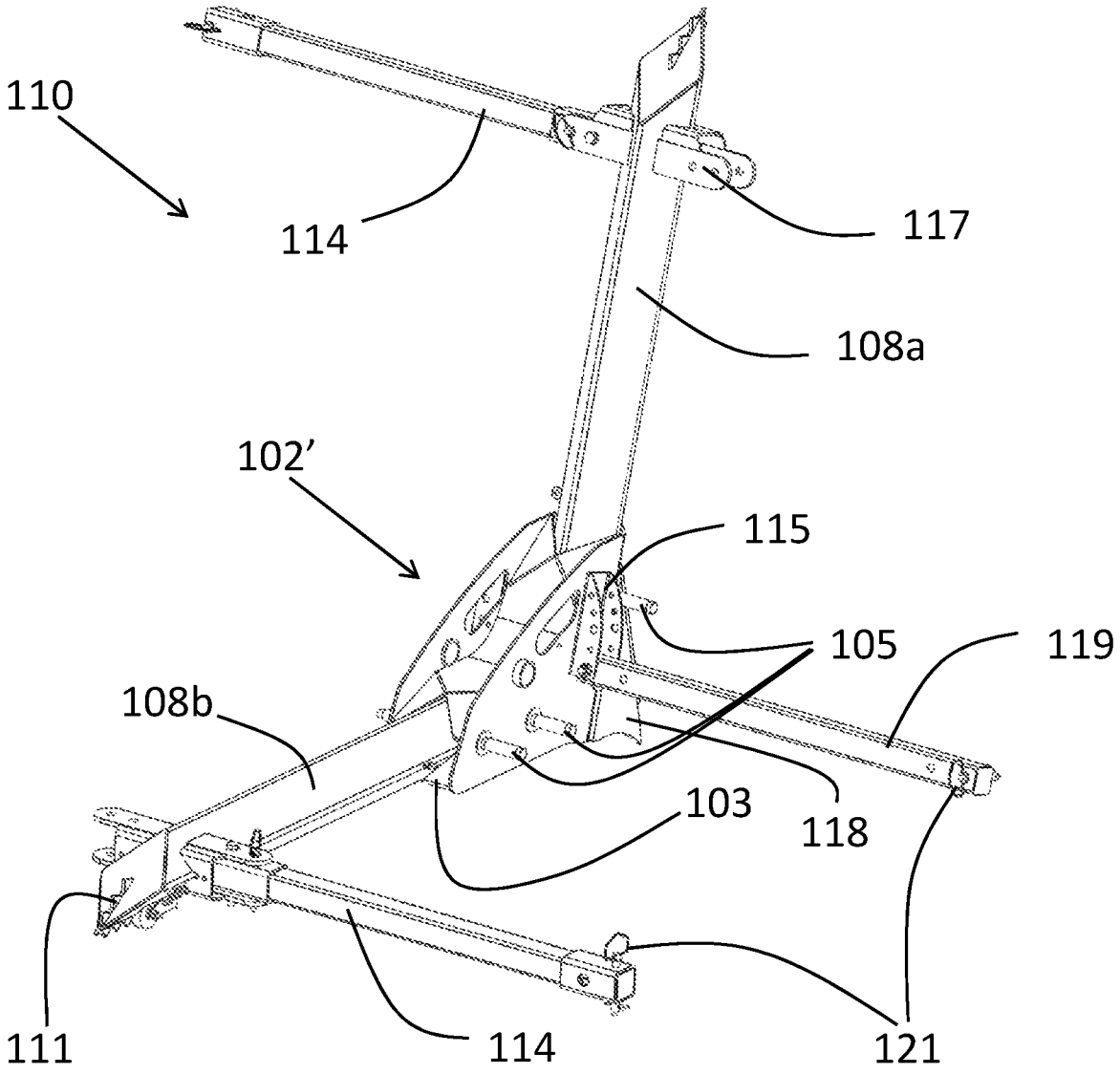
FIG. 1*d* illustrates an isometric view of the connecting bracket and two poles assembled to form the basic unit of the modular barrier shown in FIG. 1*c*.

Reference is now made also to FIG. 1*d* illustrating a view of the connecting bracket and the two poles assembled to form the basic unit of the modular barrier shown in FIG. 1*c*. In the assembled form of basic unit 110, The pole 108*a* that is partially inserted into pocket 104' is in an upright position and the second pole 108*b*, which is partially inserted to within pocket 106', is parallel to the ground. The connecting bracket 102' itself has a profile that is also of substantially square or rectangular profile that is provided with a basis 103 that can be steadily placed on the ground with the pockets directed to the correct directions so as to have the poles connected.

The connection of the poles 108*a* and 108*b* and the connecting bracket 102' is performed using pins that are designed to rapidly allow the users to assemble the basic units. Preferably, three pins 105 are provided to connect the connecting bracket 102' to the poles 108*a* and 108*b*. The poles as well as the connecting bracket are provided with corresponding bores 112 through which the pins are inserted. The pins are solid bars, preferably made of alloy steel having corresponding strength and is characterized by its good fatigue resistance. It should be mentioned that any type of rivet, screw or any other similar connecting element can be inserted through bores 112 so as to withhold the end of the pole within the pocket of the connector. As mentioned herein before, the connecting bracket is designed so as to establish a predetermined angle between the two poles while the angle between the poles should preferably be about 110°±10° and in any case, more than 60°.

Poles 108*a* and 108*b* are provided at their free end with spikes 111 that are laser cut sheets of metallic material such as steel. Spikes 111 are designed to inflict additional damage to the vehicle that hits the barrier.

Each pole 108, 108*a* or 108*b* is provided with a connecting element adapted to be connected to an adjacent pole, in the figure, a rotating bar 114 that is connected to the pole through flanges 116 that are provided in the vicinity of the free ends of the poles. Bar 114 is preferably shorter than the pole and is rotated between two states, a resting state (as shown in FIG. 1*b*), in which the bar is adjacent and parallel to the pole, and an active state (Can be seen in FIGS. 1*c* and 1*d*), in which the bar 114 is rotated away from the pole and it is substantially perpendicular to the pole. Rotating bar 114 is provided with another flange 117 that is positioned on the other side of the pole, opposite to flange 116. Flanges 117 are adapted to receive the free side of the bars Bars 114, when perpendicular to the poles when assembled to the connecting brackets, can be connected to adjacent structures such as basic unit 110. The connection is made between the free end of the connecting bars 114 and the flanges 117. Other possible connecting elements can be provided in order to connect the poles to each other as will be shown herein after.

Optionally and preferably, connecting bars 114 are provided at their ends with a sleeve adapted to strengthen the areas of connection that are considered to be prone to failures do to the drilled bores for connections.

Basically, it should be understood that the modular barrier comprises a plurality of building blocks—the connecting bracket, the poles, and the connecting elements. in order to assemble the barrier, the poles are received within a receiving pocket in the bracket to form an L shaped structure while substantially parallel poles are connected by the connecting elements. Additional or optional connecting elements can connect two adjacent brackets. Adjacent connecting brackets in the modular barrier are organized so that the receiving pockets are all directed to the same directions.

Optionally and similarly to connecting bars 114 that connects one basic unit to the other, additional connecting bars 119 that is adapted to further connect the basic units are provided. The connection is made through the connecting brackets 102'. Connecting bars 119 are connected to the side of connecting bracket 102' through a guiding flange 115. Guiding flange 115 is designed to guide the connecting bar 119 and rest within its sides when disassembled (not shown in the figure) and rotatably directed to another basic unit (as shown in FIGS. 1*c* and 1*d*). The free end of connecting bars 114 and connecting bars 119 are provided with bores that correspond to bores provided in the opposite flanges 117 or corresponding flanges in the connecting bracket through which connecting arm pins 121 may pass and secure the connection. Connecting arm pins 121 are preferably made of forged high carbon steel or other material that can endure sheer forces and is fatigue resistance. Safety R pins are provided so as to secure the pins 121 in place.

Connectors 102 and 102' are preferably provided with at least one pointing element 118 adapted to make sure the placement of the connectors is secured and if overturned when a vehicle runs over it, the pointing element provides a thrusting point as will be explained herein after.

Optionally and preferably, connector 102 is further provided with strengthener 120 that secures the angle between the two pockets of the connector.

Figure 1E:
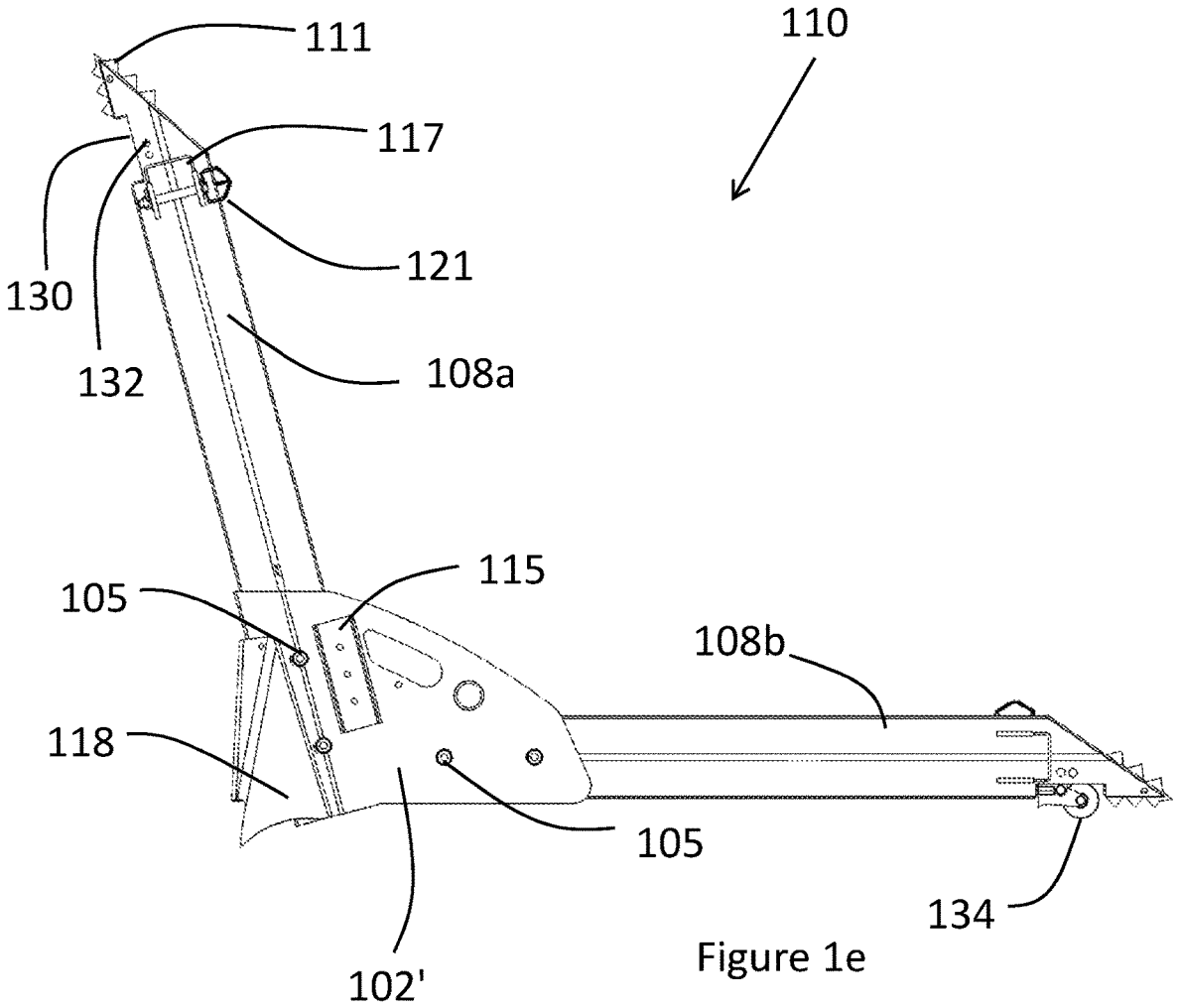
FIG. 1*e* illustrates a side view of the assembled connecting bracket and two poles shown in FIG. 1*d*.

Reference is now made to FIG. 1*e* illustrating a side view of the assembled connecting bracket and two poles shown in FIG. 1*d* for a clearer view of the basic unit 110. The poles 108*a* and 108*b* are optionally and preferably further provided relatively close to their free end that is distal from the connecting bracket 102' with a recess 130 in the pole and optionally two holes 132. Two holes 132 and recess 130 are adapted to accommodate a wheel 134 that is connected to pole 108*b* that is adjacent to the ground. The wheel 134 is the point that touches the ground onto which the barrier stands so as to be able to easily and promptly move the barrier from one place to another.

Figure 1F:
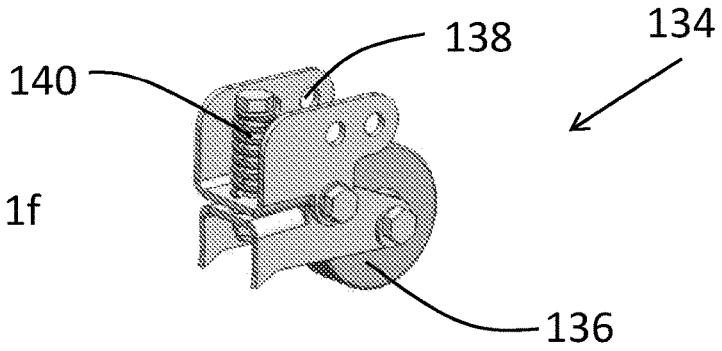
FIG. 1*f* illustrates a wheel to be attached to the pole shown in FIGS. 1*c*, 1*d* and 1*e*.

Reference is now made to FIG. 1*f* illustrating a wheel to be attached to the pole shown in FIGS. 1*c*, 1*d*, and 1*e*. Optionally and preferably, wheel 134 is a collapse spring loaded wheel 136 that is attached through corresponding bores 138 to the holes 132 of pole 108*b*. The wheel 134 is provided with a loaded spring 140 that is configured to collapse once a vehicle hits the barrier and starts to drag it. Wheel 134 is adapted to assist in moving the barrier as will be explained herein after and collapses in order to increase the friction of the pole with the ground in case of need.

Figure 2:
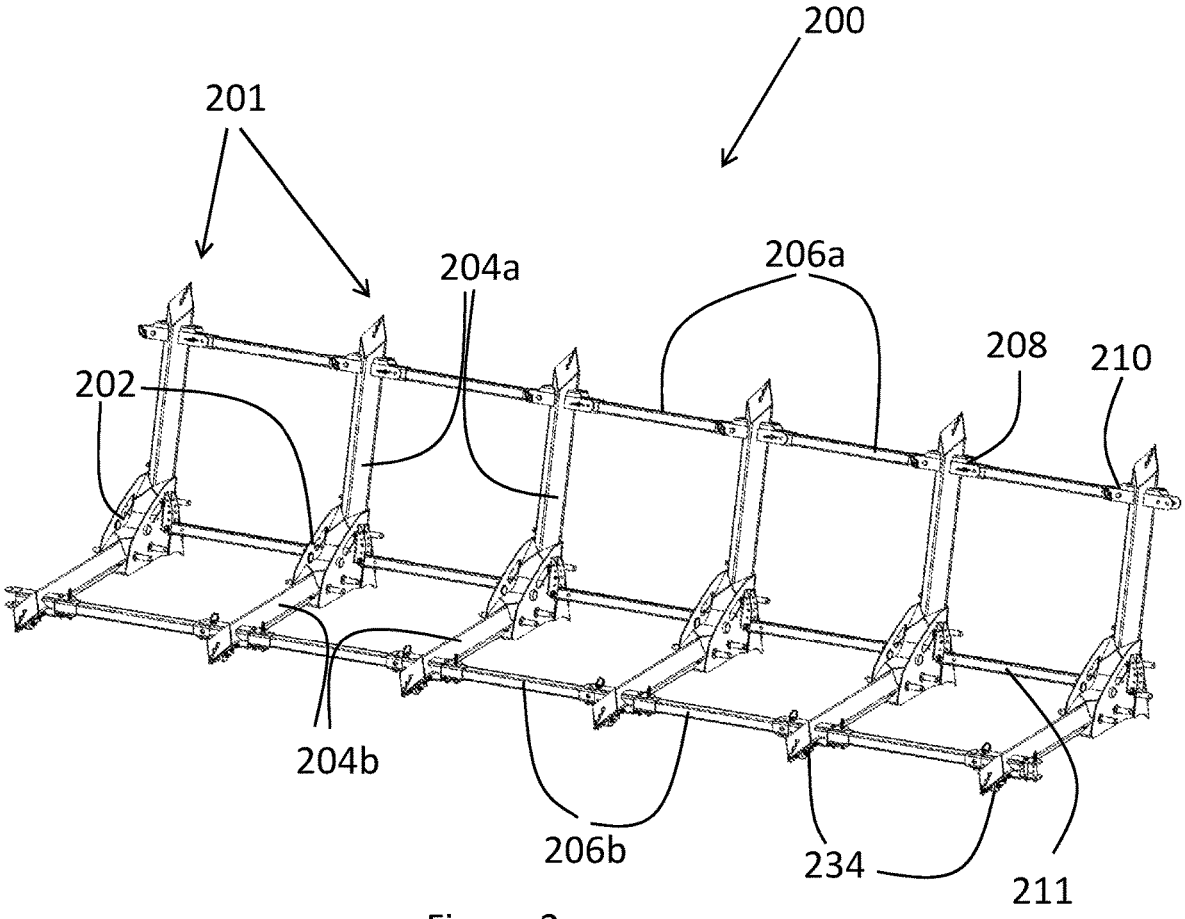
FIG. 2 illustrates the assembled barrier made of building blocks as shown in FIGS. 1*a-e*.

Reference is now made to FIG. 2 illustrating the assembled barrier made of building blocks as shown in FIGS. 1*a-f*. As mentioned herein before, the barrier as disclosed herein is a modular barrier that can be made of number of basic units or structures as needed according to the width of the road, area, or an opening that need to be blocked. The modular barrier 200 is built out of an amount of basic structures or units 202 that is adequate to the length of the barrier that is needed. Each of basic units 201 of the assembled modular barrier 200 is made of the building blocks as shown herein before, and particularly, a plurality of connectors 202 to which a plurality of poles 204*a* and 204*b* are connected. Poles 204*a* are connected while directed upwardly and poles 204*b* are directed to be substantially parallel to the ground. As mentioned herein before, the poles 204*a* and 204*b* are identical or very similar so as to facilitate their assembly. The rotating bars 206*a* and 206*b* are opened to a position in which they are perpendicular to the corresponding poles 204*a* and 204*b*, respectively. As mentioned herein before, the bars 206*a* and 206*b* are rotated about a flange 208 to which they are pivotally connected. The free end of the rotating bar is designed so it can be secured into the flange 210 of an adjacent pole that is also free to receive and be connected to the bar.

In a similar manner, bars 211 are connected between one connector 202 to the other. Parallel bars 206*a*, 206*b*, and 211 are only one preferred embodiment with possible connectivity of the units one to the other. Other possibilities of connecting the units is possible as well.

The poles that are on the ground are preferably provided with a wheel 234 facing to the ground and rests on it as described herein before.

Figure 3A:
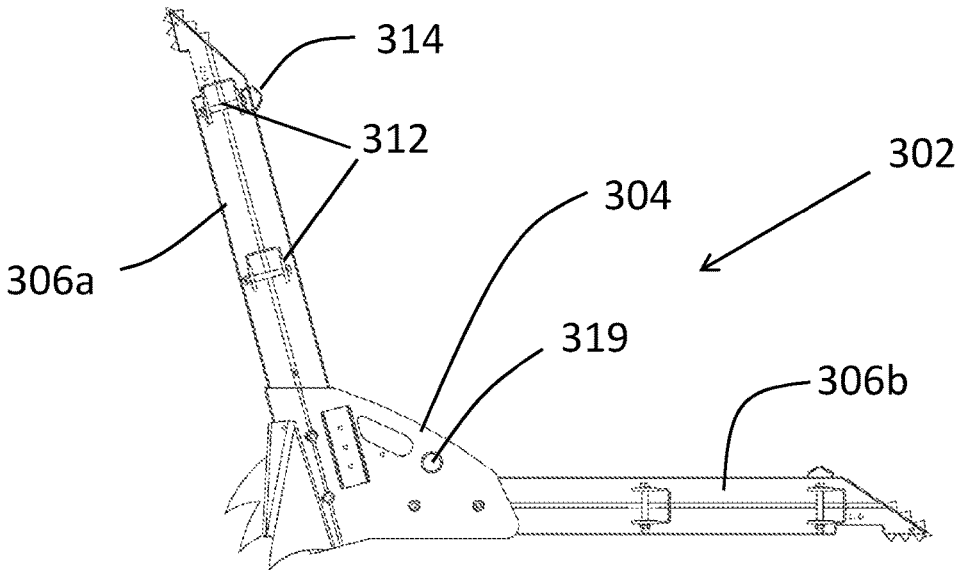
FIG. 3*a* illustrates a side view of the basic unit in accordance with another exemplary embodiment of the disclosed subject matter.
Figure 3B:
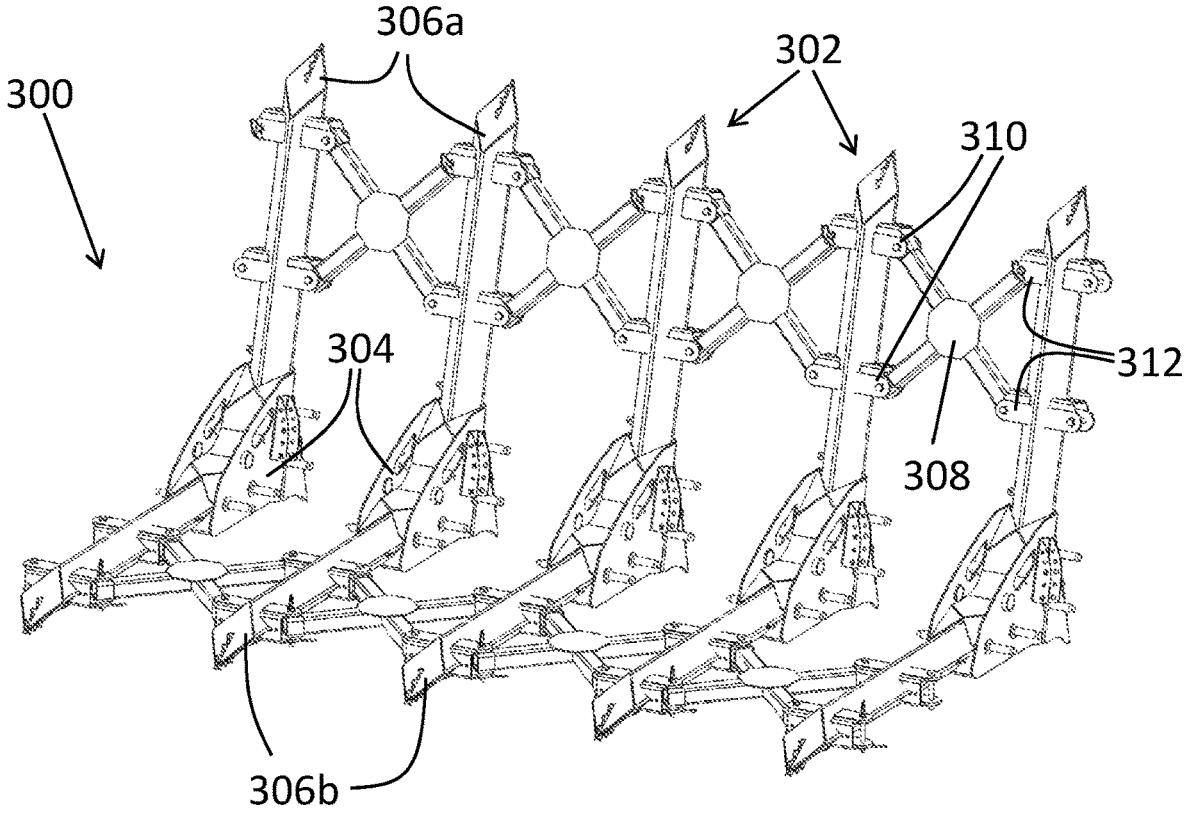
FIG. 3*b* illustrates an assembled barrier in accordance with another exemplary embodiment of the disclosed subject matter.

Reference is now made to FIGS. 3*a* and 3*b* illustrating a side view of the basic unit and an assembled barrier in accordance with another exemplary embodiment of the disclosed subject matter. Barrier 300 comprises several basic units 302, each comprises a connector 304 to which two poles 306*a* and 306*b* are connected similarly to as described herein before.

The connectivity of the basic units, one to the other, is different that the connection that was herein before disclosed, a fact that may change the distance between one unit to the other. X type connection 308 is provided to the poles 306*a* and 306*b*. Pole 306*a* is provided with two flanges 310 configures to be connected to the X type connection 308 on one side of the X connection, connected in its two free ends while two opposite flanges 312 are configured to be connected to the other side of the X connection 308. Pole 306*b* is also provided with the same connection to the adjacent pole. Both connections are connected to flanges 312 using an R-pin 314 that is easily connecting the X-type connection to the flanges.

Figure 4:
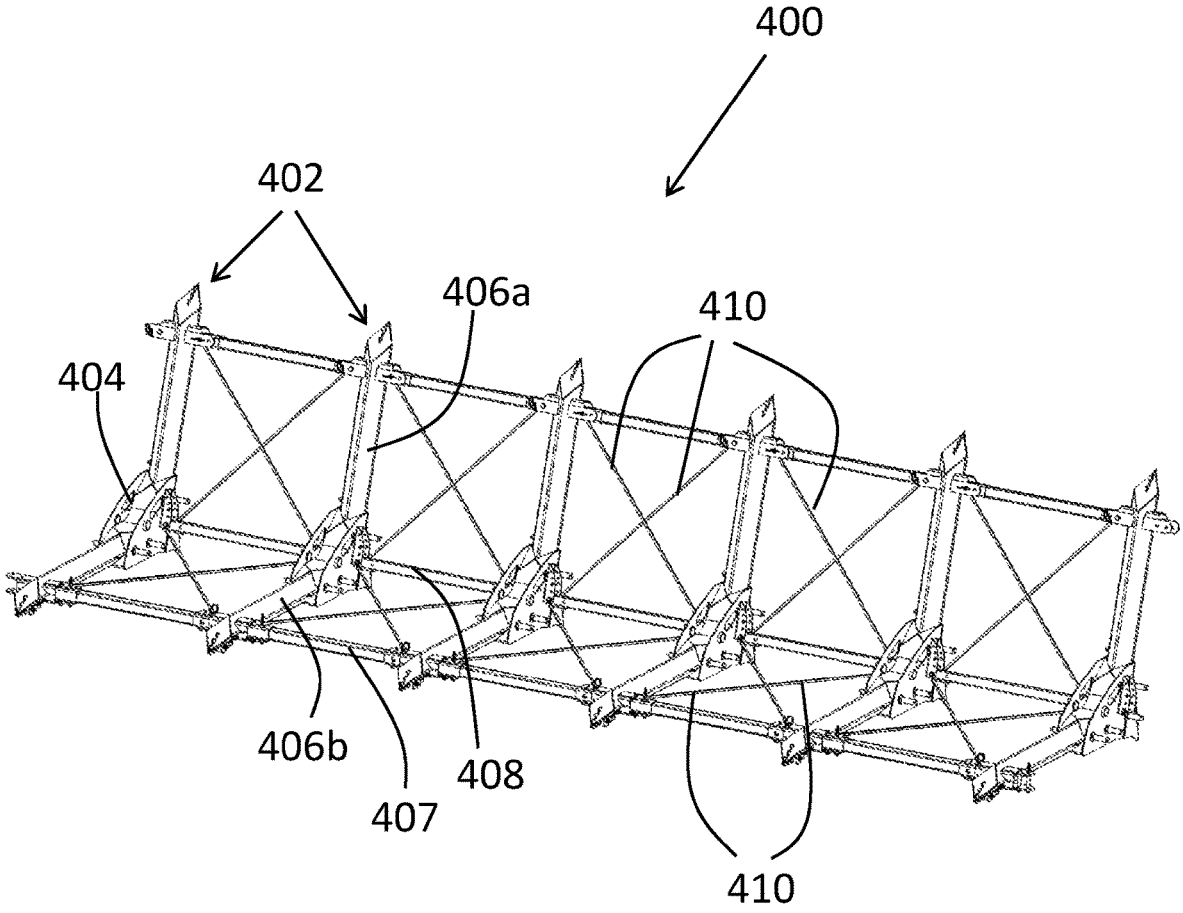
FIG. 4 illustrates an assembled barrier in which the basic units are connected using another connectivity in accordance with yet another embodiment of the disclosed subject matter.

Reference is now made to FIG. 4 illustrating an assembled barrier in which the basic units are connected using another connectivity in accordance with yet another embodiment of the disclosed subject matter. Assembled barrier 400 is made of a plurality of basic units 402, each comprises a connecting bracket 404 to which two poles 406*a* and 406*b* are connected. Poles 406*a* are directed upwardly and poles 406*a* are parallel to the ground. Poles 406*a* and 406*b* are provided with connecting bars 407 and connecting bracket 102 are provided with connecting bars 408 similarly to the connecting bars illustrated in the embodiment shown in FIG. 2. In addition and in order to provide additional strength to the connection between the basic units 402, additional rods 410 are provided and configures to be arranged in an X arrangement between the opposite and facing each other flanges that connect connecting bars 407 and connecting bars 408 of adjacent poles or connecting brackets, respectively.

It should be mentioned that any type of connection made between the basic units in order to establish the build-up of the modular barrier can be used without limiting the scope of the disclosed subject matter.

Figure 5:
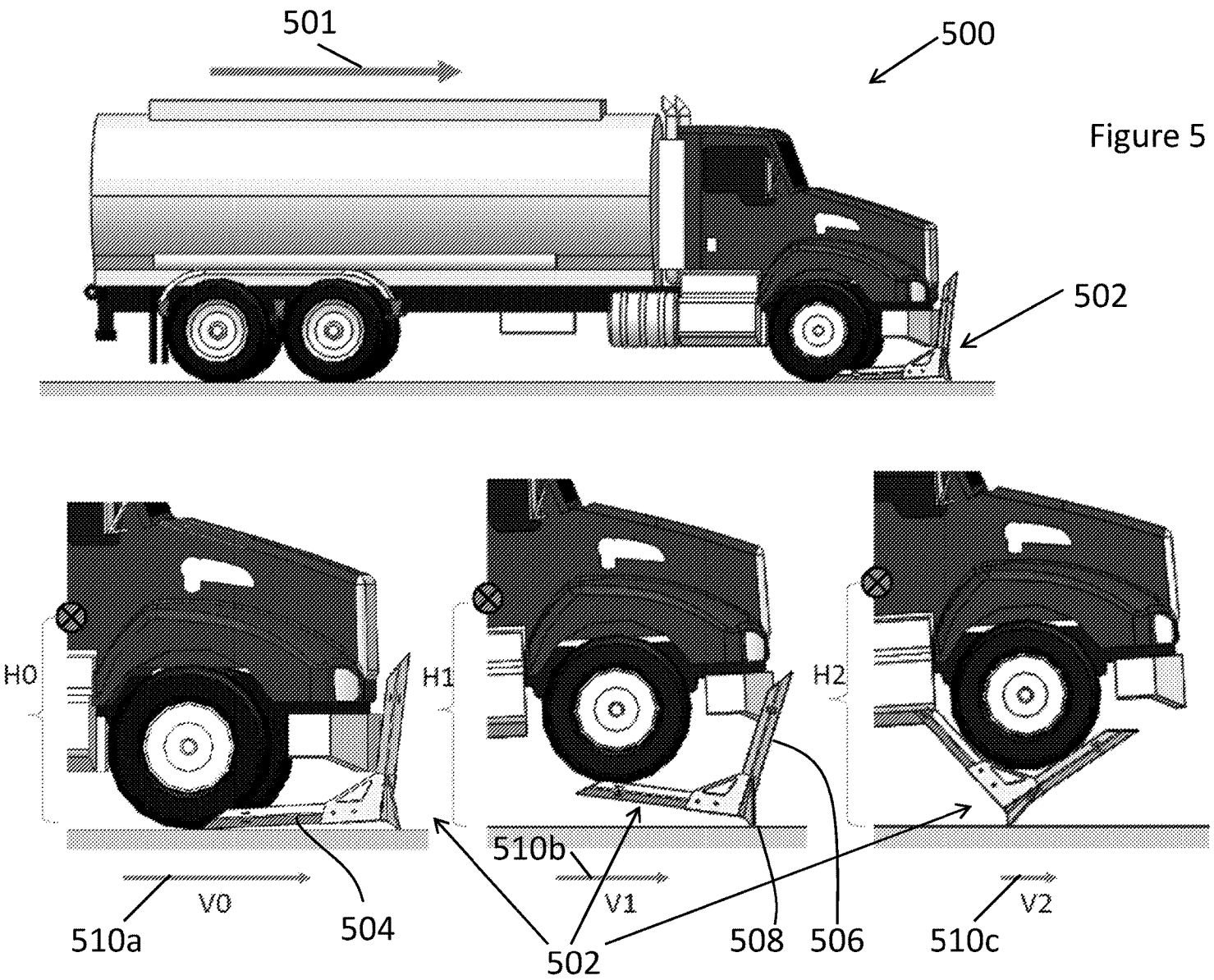
FIG. 5 illustrates a heavy vehicle stops at a barrier in accordance with some other exemplary embodiments of the disclosed subject matter, and the situation when the vehicle runs over the barrier.

Reference is now made to FIG. 5 showing a heavy vehicle stops at a barrier in accordance with some other exemplary embodiments of the disclosed subject matter, and the situation when the vehicle runs over the barrier. In the upper illustration, one can see that the vehicle 500 that drove in a direction indicated by an arrow 501 stops with its bumper at the barrier 502 while the wheels of the vehicle are slightly going over the free end of the pole that is placed on the ground. It should be mentioned that the word ground refers to sandy, rocky, rough terrain, gravel, asphalt road, a combination thereof and the like.

Returning to FIGS. 1*c* and 1*d* and the disclosure herein before of the preferred profile and placement of the pole that is placed substantially parallel to the ground, the preferred profile of the pole is rhombus that is placed on the ground within the pocket of the connecting bracket with the pointed side upright. When the vehicle starts to climb on the poles of the barrier, it's wheels pass over the pointed side of the pole. This renders instability to the vehicle that drives on a pointed surface.

In the illustrations at the lower part of FIG. 5, there are stages by which the vehicle doesn't stop at the barrier and continues to drive over it. The arrows 510*a*, b, and c illustrate the direction of the vehicle that drives forwards towards the barrier 502 in velocities of V0, V1, and V2 wherein the velocities of the vehicle is represented by the length of the arrows that are getting shorter as the vehicle proceeds towards and over the barrier. The corresponding velocities V0, V1, and V3 of the vehicle gets lower as the vehicle proceeds. The left-hand side illustration shows that the vehicle is in the relatively high velocity V0 represented by a length of the arrow 510*a* when the vehicle's bumper hits the barrier. Moreover, the stability of the vehicle 500 is deteriorated due to its climb on the sharp edge of the pole 504 and possibly due to damage inflicted on the vehicle's tire by spikes (111 in FIG. 1*d*, as an example) provided to the pole free end. The velocity V1 of the vehicle is blocked markedly as represented by arrow 510*b*. As the bumper of vehicle 500 hits and pushes pole 506, due to the force of the vehicle and the shape of the barrier, the barrier will turn over the thrusting point 508 that forms due to pointing element such as pointing element 118 shown in FIG. 1*d* that can be imbedded into the ground. As illustrated, the pole 504 that is adjacent to the ground is raised while the other pole 506 is being lowered and rotated about the thrusting point 508. The vehicle's front wheels will be trapped as shown in the illustration while the velocity V2 of the vehicle is further reduced as represented in arrow 510*c*.

Figure 6A:
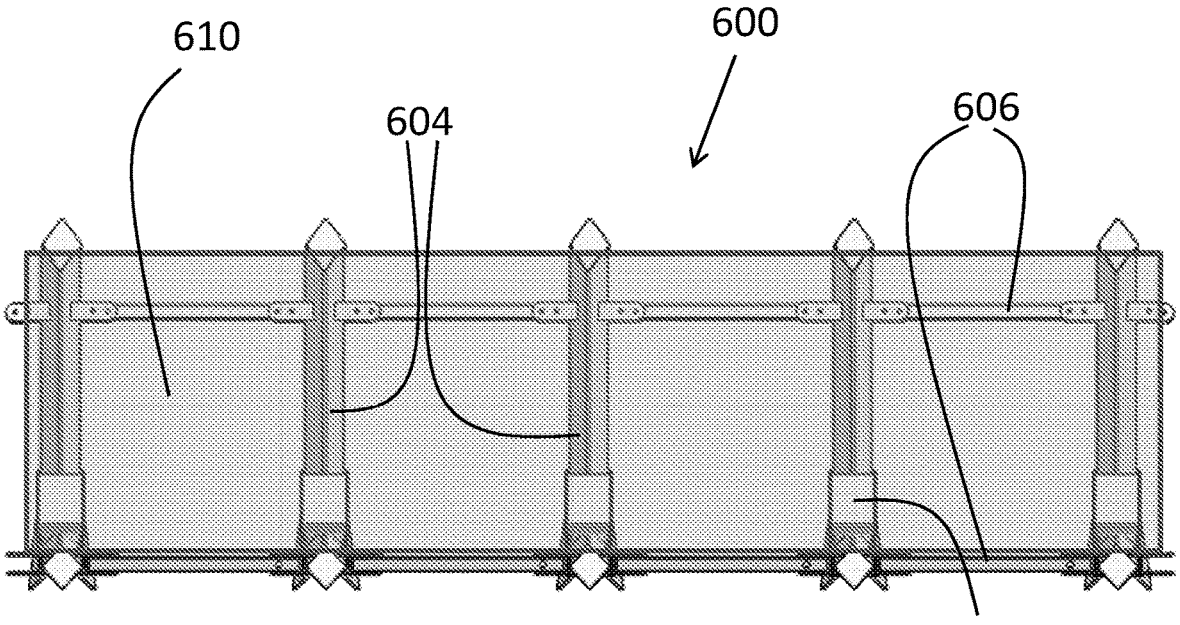
FIG. 6*a* illustrates frontal view of the barrier made of the parts shown in FIGS. 1*a* and 1*b* provided with barrier against human crowd, in accordance with some exemplary embodiments of the disclosed subject matter.
Figure 6B:
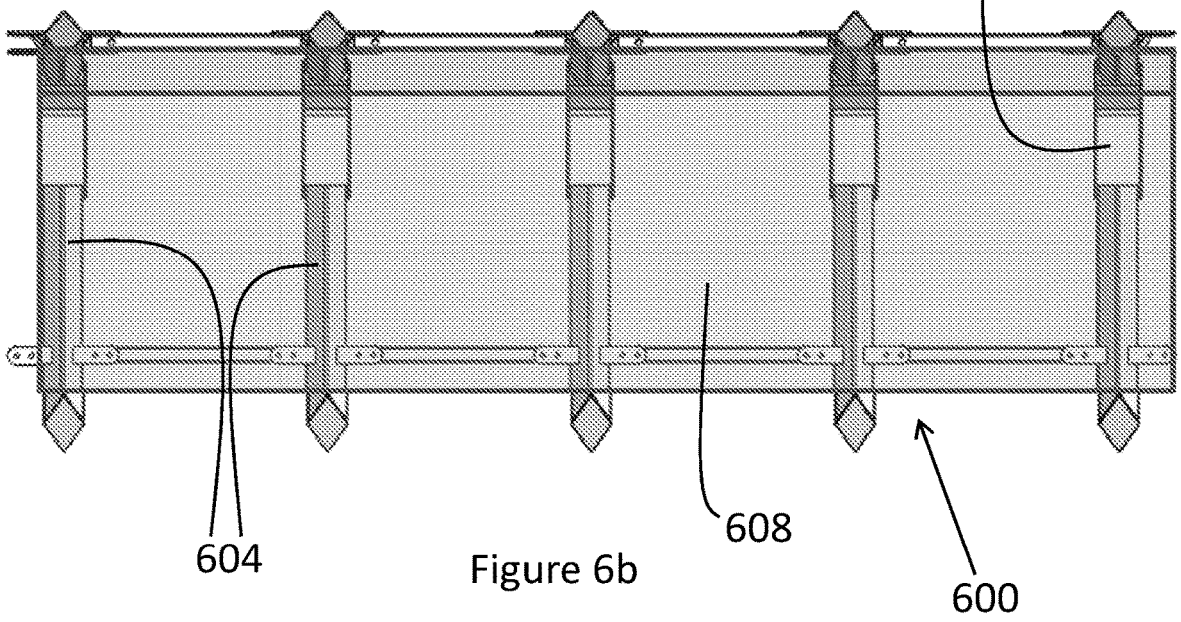
FIG. 6*b* illustrates upper view of the barrier shown in FIG. 6*a*.

Reference is now made to FIGS. 6 *a* and *b* illustrating frontal and upper views, respectively, of the barrier shown in FIGS. 1*a* and 1*b* provided with barrier against human crowd, in accordance with some exemplary embodiments of the disclosed subject matter. The barrier disclosed in this document can be used for vehicles, however, may be converted into a barrier against crowd and especially human crowd. For this purpose, a metallic screen is provided so as to block the crowd.

Barrier 600 that is similar to the barrier shown in FIG. 2 comprises a connector 602 and two poles 604 forming substantially an L shape barrier. The poles 604 are firmly connected to the connector 602. The bars 606 are opened and connecting the adjacent poles of the modular units of the barrier. When the barrier is in an open active position as shown in the FIGS. 6*a* and 6*b*, two screens, preferably metallic screens, are placed over the portions of the barrier. Screen 608 is placed and connected to the poles of the barrier that are parallel to the ground and screen 610 is placed and connected to the upright poles of the barrier 600. In this way, when crowd of people are going forward towards the barrier and step on screen 608, the barrier will not overturned due to the weight of the people that is placed on the bottom screen, however, the upright screen will not let them proceed.

It should be noted that the screens that can be made of two parts (the horizontal and the vertical portion) or made of a single portion that has an axis in its middle so as to be placed and fixed to the substantially L-shaped barrier.

Figure 7A:
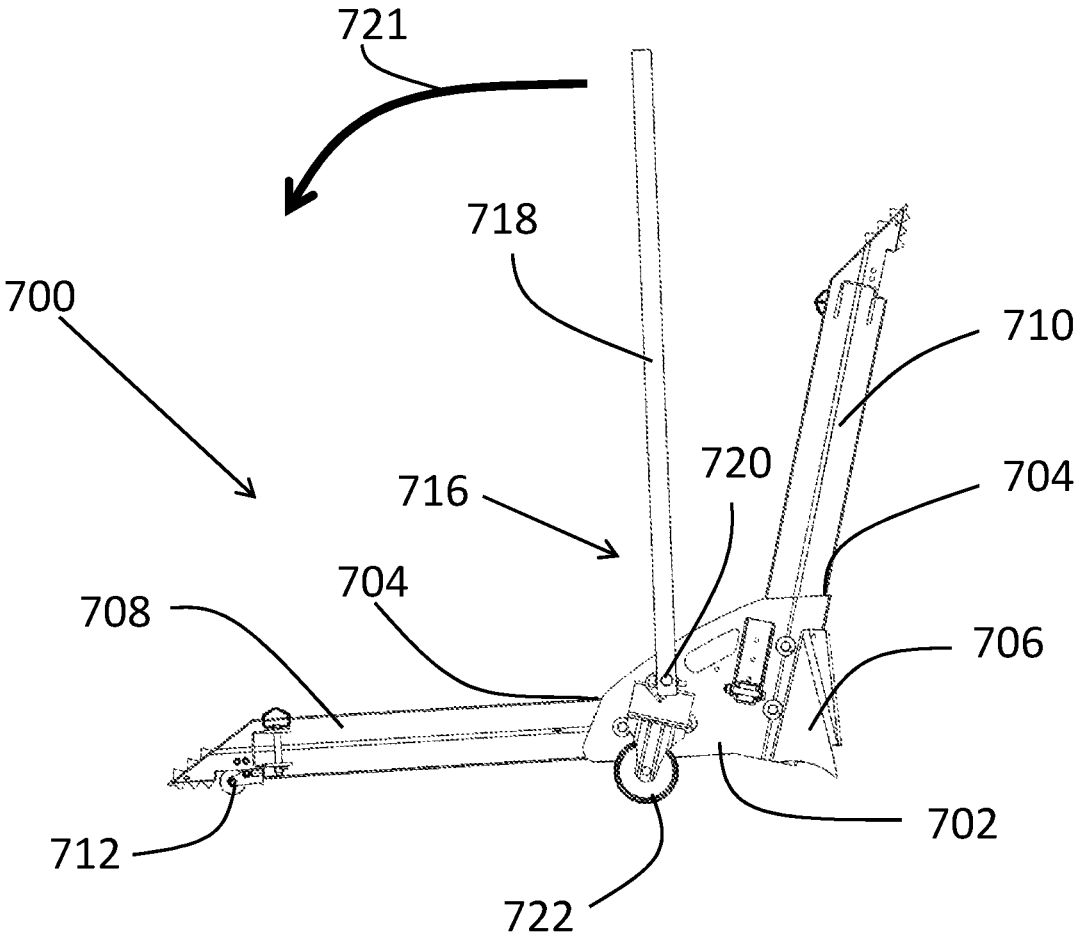
FIG. 7*a* illustrates a side view of an assembled barrier provided with a jack in accordance with some other exemplary embodiments of the disclosed subject matter.

Reference is now made FIG. 7*a* illustrating a side view of a barrier provided with a jack in accordance with some other exemplary embodiments of the disclosed subject matter. The barrier 700 is similar in regard to the basic units to the former embodiments brought herewith (FIG. 1*e* as an example): barrier 700 comprises a connecting bracket 702 provided with two pockets 704 and a pointing element 706. The barrier 700 further comprises two poles 708 and 710, while pole 708 is provided with at least one wheel 712 and therefore, this pole is inserted within the connecting bracket so that it is placed substantially parallel to the ground while the wheel 712 touches the ground. The other pole 710 can be inserted to within the pocket 704 in the connecting bracket that is directed to the vertical position relative to the ground, in an upright position. The other pole 710 doesn't have to be provided with wheels, however, it may be. The portions or the rotating bars that connect between the modular units are not shown in FIG. 7*a*, however, can be clearly seen in FIG. 7*b*. Barrier 700 is provided with a jack 716 capable of uploading the barrier 700 onto wheels 722 so as to carry the barrier from one point to the other for placement adjustments.

Figure 7B:
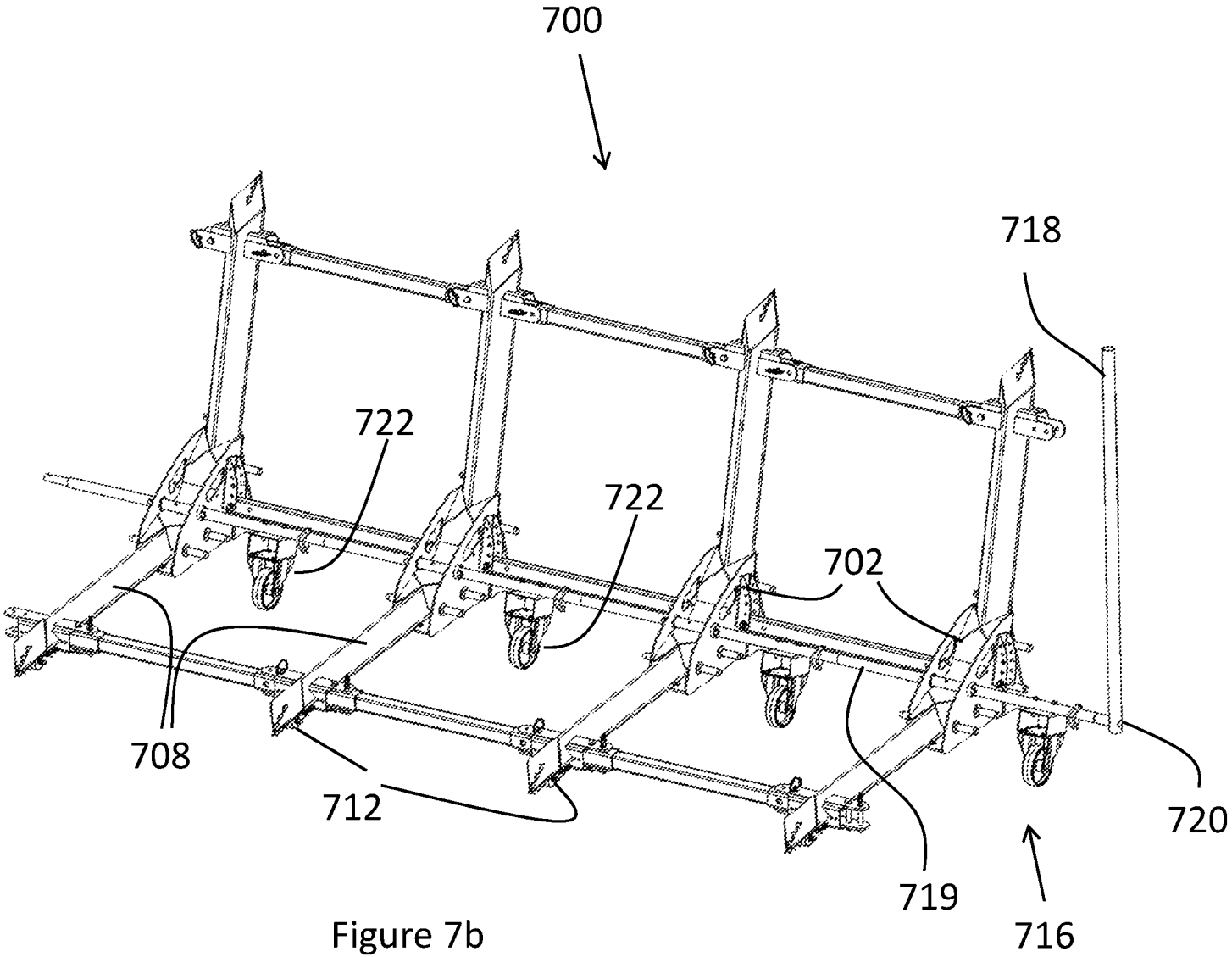
FIG. 7*b* illustrates isometric view of the barrier capable of moving in substantially rotating movement from one position to the other using a jack in accordance with exemplary embodiments of the disclosed subject matter.

Reference is now being made to FIG. 7*b* illustrating isometric view of the barrier capable of moving in substantially rotating movement from one position to the other using a jack in accordance with an exemplary embodiment of the disclosed subject matter. Barrier 700 is shown to be assembled so as to block vehicles. There are many cases in which it is desirable to move the barrier for a limited time so as to open the blockage, as an example, or to adjust it in another positioning. In those cases, the wheels 712 in the bottom portion of the poles 708 become important and useful. In order to activate them, the thrust between the pointing elements 706 and the ground should be eliminated. This is performed using the jack 716.

Jack 716 comprises a lever 718 and shaft 719 that pass through dedicated and corresponding holes 319 shown in FIG. 3*a*, as an example, in the connecting bracket 302 or 702. The lever 718 is connected to shaft 719 by a pin 720. Lever 718 is adapted to be moved by the user in a downward movement shown by arrow 721 in order to deactivate its operation and vice versa in order to activate it and allow the barrier to move. The free end of lever 718 can be grasped by the hand of the user while this movement correspondingly rotates the connected shaft 719 about its longitudinal axis. Shaft 719, which passes through the connecting brackets 702 is provided with a plurality of driving wheels 722. Optionally and preferably, the driving wheels are arranged so as a single driving wheel is provided between each basic unit of the modular barrier 700.

FIGS. 7*a* and 7*b* show a positioning of the jack 716 in which the lever 718 is upwardly positioned and placed so that the driving wheels 722 are in lower positioning in which it is active, touching the ground, and raise the pointing element 706 above the ground so as to allow the barrier 700 with the ability to move using wheels 712 and 722. The friction of the heavy metals with the ground is almost eliminated and the barrier 700 can be easily moved without having to use many working hands or machinery.

Going back to FIG. 7*a*, one can see that moving the lever 718 to a downward position according to arrow 721 rotate the wheel 722 as well as all other wheels 522 that are connected to the shaft 719 to an upper positioning in which it doesn't touch and ground and forces the barrier 700 to be supported on the pointing element 706 that sticks the barrier to a point in the ground. In this state, the barrier is steady and cannot be easily moved. as mentioned herein before, upon an incident in which a vehicle hitting the barrier, the wheels 712 that are provided on the pole 708 collapse and renders the barrier with friction that facilitate the blockage of the vehicle.

Figure 8A:
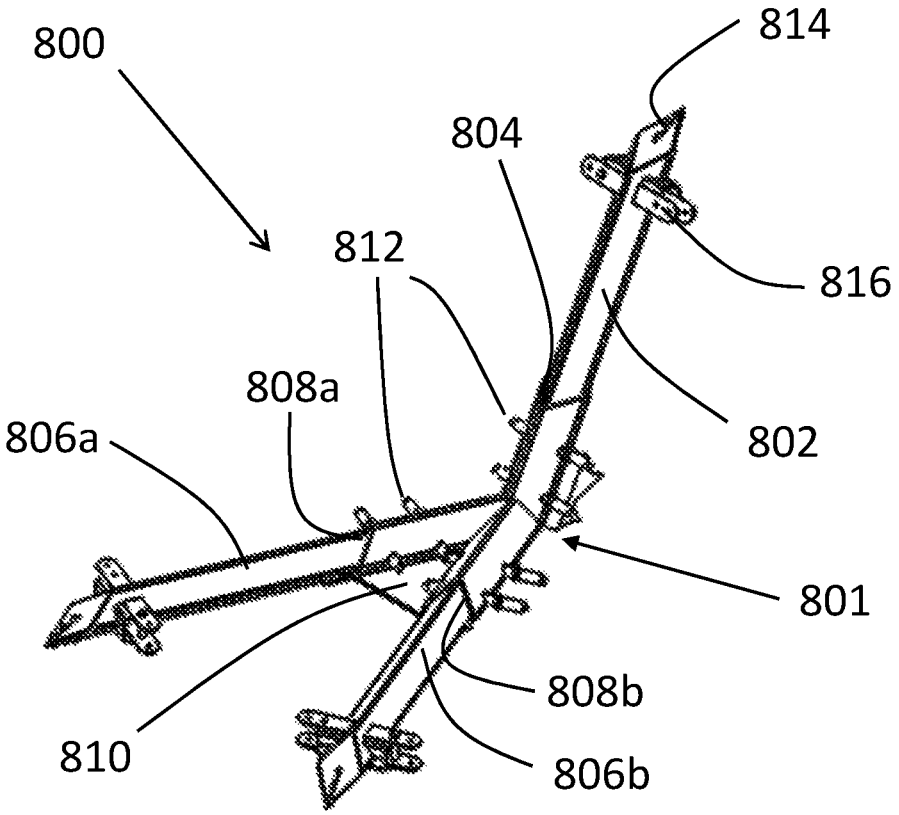
FIG. 8*a* illustrates an isometric view of a basic unit in accordance with yet another exemplary embodiment of the disclosed subject matter.
Figure 8B:
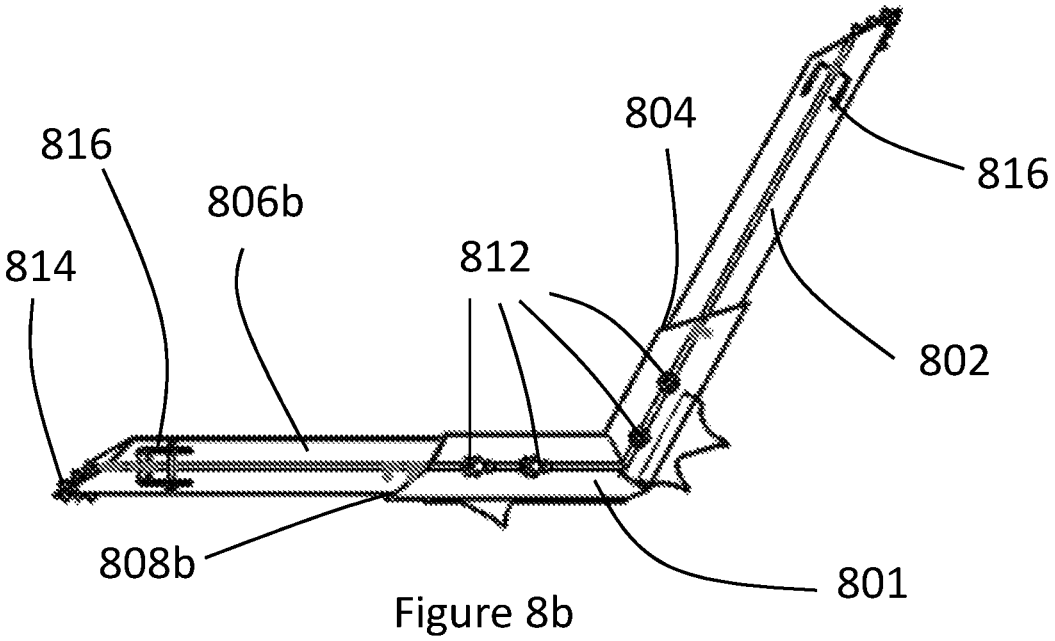
FIG. 8*b* illustrates a side view of the embodiment shown in FIG. 8*a*.

Reference is now made to FIGS. 8*a* and 8*b* illustrating an isometric view of a basic unit in accordance with yet another exemplary embodiment of the disclosed subject matter. Basic unit 800 is shown to be assembled. The basic unit 800 comprises a bracket 801 having three pockets as will be explained. A pole 802 is inserted into a pocket 804 in an upright position while two other poles 806*a* and 806*b*, which are inserted to within pocket 808*a* and 808*b*, respectively, are parallel to the ground. As mentioned herein before, the bracket 801 has three pockets, one directed upwardly so that the pole is in an upright position and two pockets that are substantially positioned laterally to the upright pole and are positioned so that they are on the same surface connected by a middle fastener 810, wherein the pockets 808*a* and 808*b* are directed to the same plane with an angle of 20-90 degrees between them. The bracket in this architecture is steadily placed on the ground so as to provide a steady barrier as will be shown in the following figure.

The connection of the poles 802, 806*a*, and 806*b* to the bracket 801 is performed using pins that are designed to rapidly allow the users to assemble the basic units. Preferably, two passthrough pins 812 are provided to connect each pole to the bracket. The poles as well as the connecting bracket are provided with corresponding bores through which the pins are inserted. The pins are solid bars, preferably made of alloy steel having corresponding strength and is characterized by its good fatigue resistance. It should be mentioned that any type of rivet, screw or any other similar connecting element can be inserted through the bores (concealed in FIGS. 8*a* and 8*b* by the pins) so as to withhold the end of the pole within the pocket of the bracket. It should also be mentioned that any number of pins can be used in order to firmly connect the poles to the bracket without limiting the scope of the subject matter. As mentioned herein before in the description of other embodiments, the bracket is designed so as to establish a predetermined angle between the upright poles and the lateral poles while this angle should preferably be about 110°±10°.

Poles 802 as well as 806*a* and 806*b* are provided at their free end with spikes 814 that are laser cut sheets of metallic material such as steel. Spikes 814 are designed to inflict additional damage to the vehicle that hits the barrier.

Each pole 802 as well as 806*a* and 806*b* is provided with flanges 816 adapted to maintain a connection to an adjacent pole of another unit.

Figure 9:
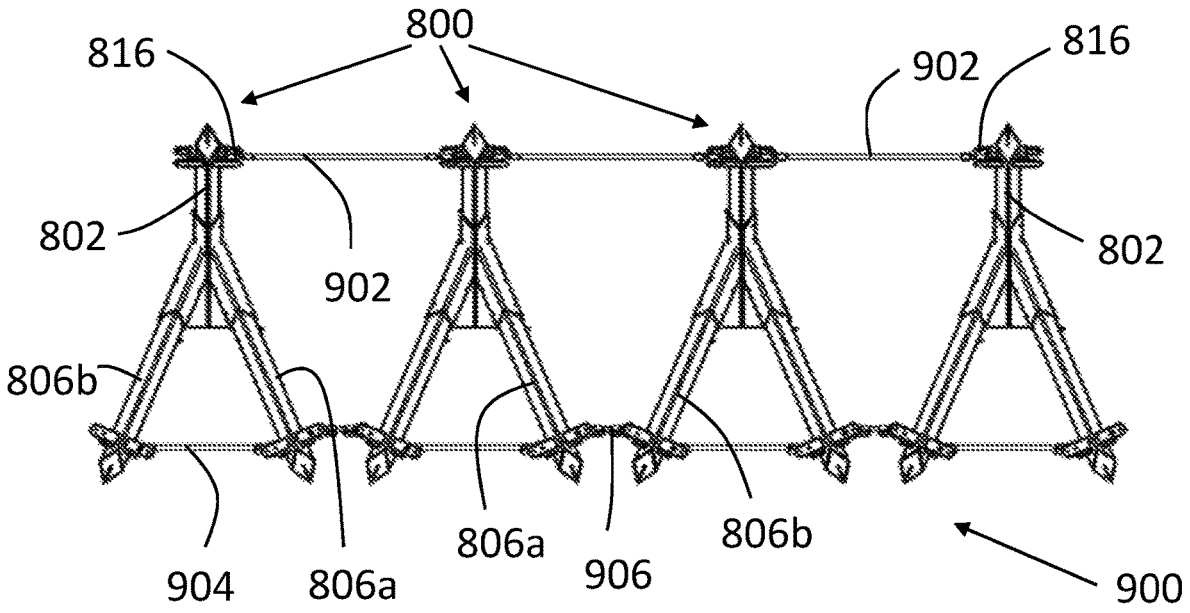
FIG. 9 illustrates a barrier made of units similar to the units shown in FIGS. 8*a* and 8*b*.

Reference is now made to FIG. 9 illustrating a barrier 900 made of units 800 similar to the units shown in FIGS. 8*a* and 8*b*. In order to assemble the barrier 900, connecting bars 902 are connected between upwardly positioned poles 802 while their ends are connected to flanges 816 that are provided in the vicinity of the free ends of the poles, as shown previously. The connecting bars 902 should be in such a length that the lateral poles 806*a* or 806*b* are kept apart from such lateral poles of an adjacent unit.

Optionally and preferably, poles 806*a* and 806*b* are connected to each other by a connecting bar 904 that fastens the structure.

Optionally and preferably, adjacent lateral poles should also be connected to each other. Therefore, pole 806*a* that is adjacent to pole 806*b* of another unit 800 is connected to pole 806*b* using a rod 904 so that the lower portion of the barrier 900 is steady as the upper portion.

Rod 904 can be a rod or a chain or any other connecting means that can steadily support the connection between the adjacent units 800 that establish the barrier 900. This applied for all embodiments shown in this disclosure and its variations.

Figure 10:
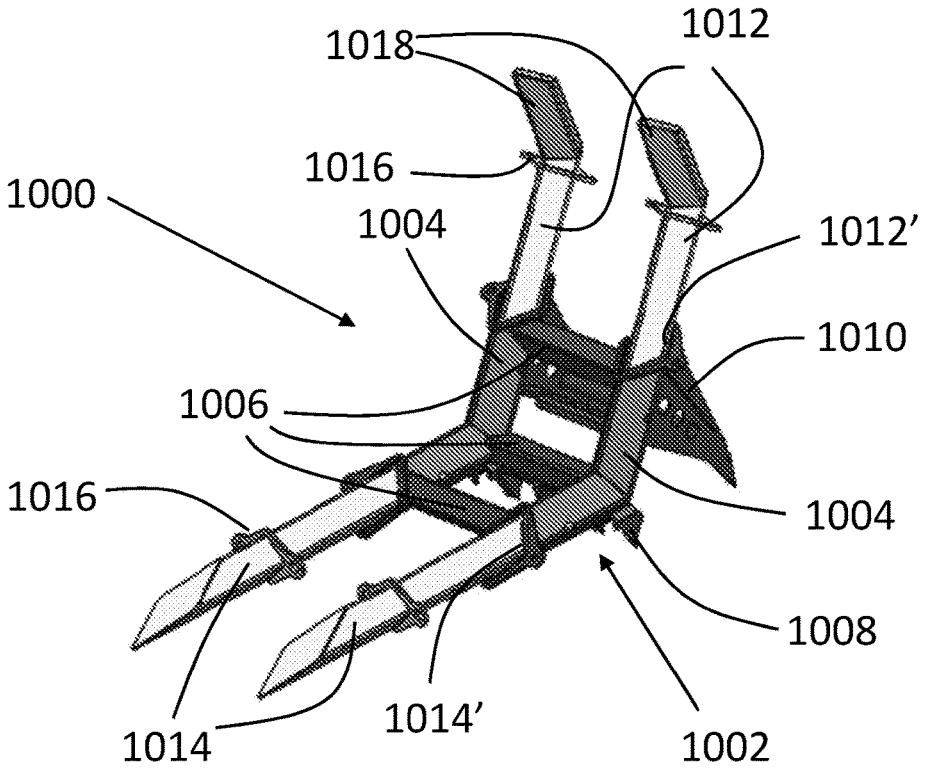
FIG. 10 illustrates an isometric view of a basic unit in accordance with an additional exemplary embodiment of the disclosed subject matter.

Reference is now made to FIG. 10 illustrating an isometric view of a basic unit in accordance with an additional exemplary embodiment of the disclosed subject matter. Unit 1000 comprises a bracket 1002 made of two substantially L shaped tubes 1004 connected to each other by at least one, and preferably three connecting chunks 1006, which are connected in three strategic places (upper, lower, and in the bent) to the L shaped tubes 1004, that render extreme strength to the bracket 1002. Alternatively, the chunks can be in an X orientation between the two tubes. The angle between the lateral tubes that are placed substantially parallel to the ground and the upwardly directed tubes should preferably be more than 60°.

A pointing element 1008 as well as an additional pointing heel 1010 are provided to the bracket 1002 so as to render additional strength and stability in case a vehicle is bumping into the basic unit 1000. The additional pointing heel 1010 provides among other benefits, a thrusting point that in some cases is effective enough even to turn the vehicle upside down.

Basic unit 1000 is further comprising poles that are adapted to be inserted into the openings in the L shaped tubes 1004. The openings of the tubes function as pockets for the poles. Two poles 1012 are inserted in an upright position through the upper openings 1012' of the tube and two poles 1014 are inserted in a horizontal position (lateral) through the lower openings 1014'.

The profiles of the tube openings as well as the profiles of the poles are corresponding to each other so that the insertion is very easy and straight forward. As mentioned herein before and not seen in FIG. 10, after inserting the poles within the openings of the tubes that act as pockets, the is a connection of pins that pass through the tubes and the poles and connect them together.

Alternatively and preferably, the two types of poles—the upwardly directed poles and the laterally directed poles—are different in their structure and shape. The laterally directed poles 1014 are similar to the poles shown herein before however, the upwardly directed poles 1012 have two portions. The portion that is close to the bracket and is inserted to within the openings 1012' are provided with the same profile as the other poles while the upper portion of the pole is bent and flattened to establish a pointer 1018 that is directed to the direction from which the vehicle is to be stopped. This feature may inflict additional damage to the vehicle that bumps into the barrier.

Flanges 1016 are provided to the poles so as to connect several units 1000 together in a line so that a barrier 1100 is established. Other flanges can be provided as well. The connection can be performed using any type of connection that was disclosed herein before or any other possible connection. Moreover, spikes can be added to the basic unit in order to puncture the tires of the coming vehicle.

Figure 11:
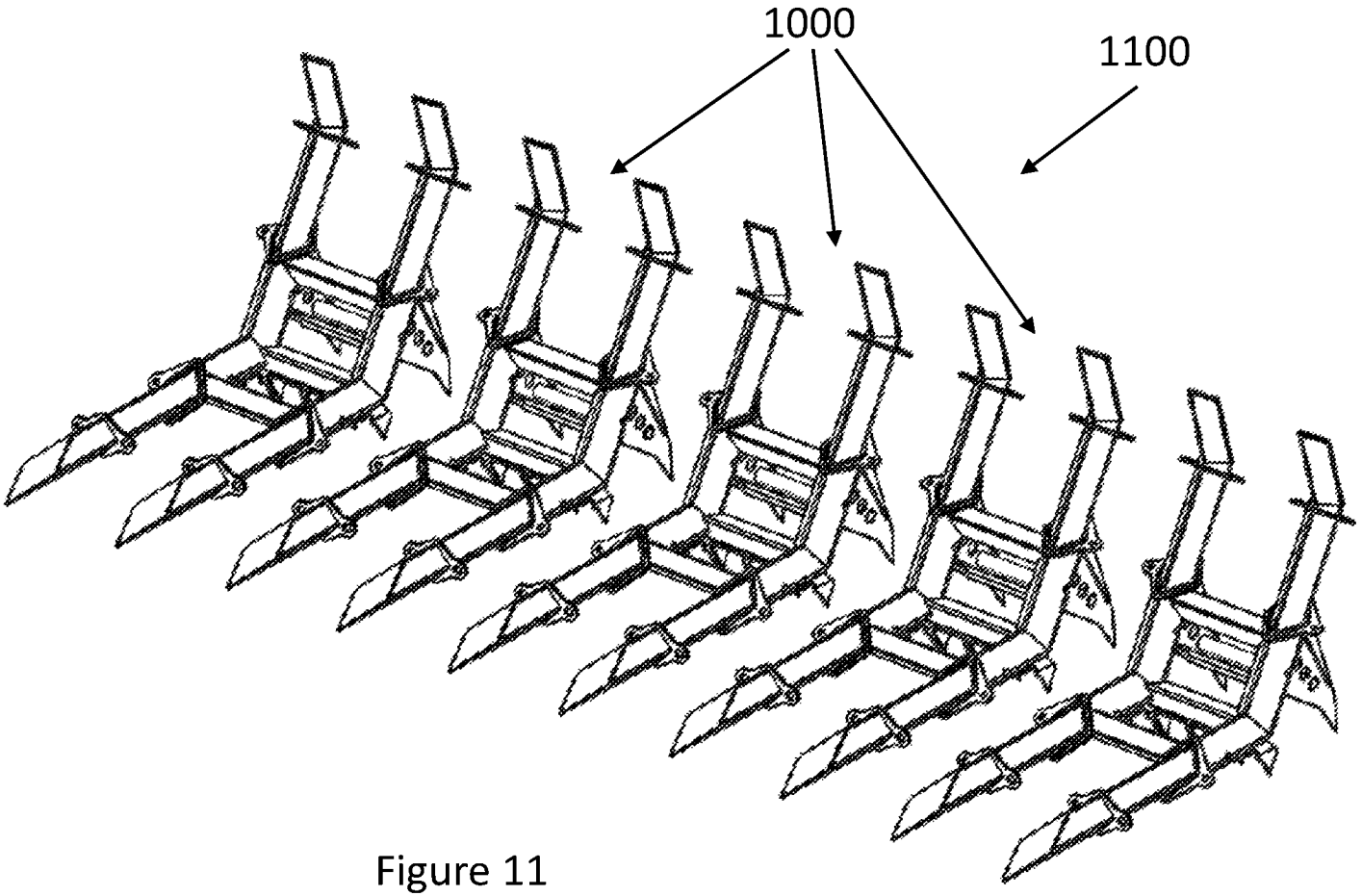
FIG. 11 illustrates an isometric view of a barrier made of units similar to the units shown in FIG. 10.

Reference is now made to FIG. 11 illustrating an isometric view of a barrier made of units similar to the units shown in FIG. 10. Barrier 1100 is shown in FIG. 11 while the basic units 1000 are not connected to each other. Since the basic units are so firm, each one of them can establish a barrier by itself. However, although it is not shown in the figure, the units can be connected together using methods that were disclosed herein above or other connecting methods.

It should be emphasized that the barriers disclosed in this document are very easily assembled as well as disassembled while they are very easily transported, especially due to the fact that in many of the cases, it is comprised of two building blocks.

The poles and the brackets used in order to build the barrier according to the present subject matter are made of very strong materials as mentioned herein before, however, the poles, as an example, can be enforced with internal means such as I beam that can be incorporated within the pole. Other methods of enforcement can be employed themselves.

It should be mentioned that all embodiments shown herein as well as similar embodiments can be transported after assembled to a barrier using several units using a jack as shown in FIGS. 7*a* and 7*b* or any other jack that can assist in carrying the barrier or rotating it in the site.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A building block to be aligned with other building blocks to build a modular barrier to stop objects that are moving on a ground, wherein the building block comprises:

a connecting bracket having at least two receiving pockets wherein at least one of said at least two receiving pockets is laterally directed only in a direction facing the objects that are moving on the ground and at least one of said at least two receiving pockets is directed in a predetermined angle relative to the at least one of the receiving pockets that is laterally directed; and a plurality of poles, wherein at least one of the poles is configured to be received within the at least one of the receiving pockets that is laterally directed so that the at least one of the poles is substantially parallel to the ground and extends only in a direction facing the objects moving on the ground and wherein at least one of the poles is configured to be received within one of the at least two receiving pockets that are directed in the predetermined angle so as to allow the modular barrier to stop the objects.

2. The building block as claimed in claim 1, which further comprises a plurality of connecting elements capable of connecting two adjacent building blocks.

3. The building block as claimed in claim 2, wherein at least one of the plurality of connecting elements is provided to each pole or to the connecting bracket.

4. The building block as claimed in claim 2, wherein the poles or the connecting bracket are provided with flanges configured to be connected to the connecting elements.

5. The building block as claimed in claim 1, wherein one of said at least two receiving pockets is directed in the predetermined angle and at least two receiving pockets are laterally directed.

6. The building block as claimed in claim 5, wherein said at least two receiving pockets that are laterally directed are two receiving pockets.

7. The building block as claimed in claim 6, wherein the two receiving pockets are apart from each other by about 20-90 degrees and are positioned on the same plane.

8. The building block as claimed in claim 1, wherein two of said at least two receiving pockets are directed in the predetermined angle and two receiving pockets are laterally directed.

9. The building block as claimed in claim 1, wherein said at least two receiving pockets are two receiving pockets.

10. The building block as claimed in claim 1, wherein the predetermined angle is more than 60°.

11. The building block as claimed in claim 10, wherein the predetermined angle is 110°+10°.

12. The building block as claimed in claim 1, wherein the pole and the receiving pockets have a rhombus profile.

13. The building block as claimed in claim 1, wherein the connecting bracket is provided with at least one pointing element that provides a thrust point over which the barrier is rotated upon hit of the object, so that the at least one pointing element is being imbedded into the ground.

14. The building block as claimed in claim 1, wherein at least one of the plurality of poles is provided with spikes at a free end that is not to be received within the receiving pocket.

15. The building block as claimed in claim 1, wherein a wheel is connected to at least one of the plurality of poles wherein the wheel has two states, a collapse state when weight is implemented onto the at least one of the plurality of poles, and an active state when the modular barrier is to be moved.

16. The building block as claimed in claim 1, wherein the connecting elements are bars that are positioned substantially perpendicular to the poles.

17. A building block to be aligned with other building blocks to build a modular barrier to stop objects that are moving on a ground, wherein the building block comprises:

a connecting bracket having at least two receiving pockets wherein at least one of said at least two receiving pockets is laterally directed and at least one of said at least two receiving pockets is directed in a predetermined angle relative to the at least one of the receiving pockets that is laterally directed; and a plurality of poles, wherein at least one of the poles is configured to be received within the at least one of the receiving pockets that is laterally directed so that the at least one of the poles is substantially parallel to the ground and wherein at least one of the poles is configured to be received within one of the at least two receiving pockets that are directed in the predetermined angle so as to allow the modular barrier to stop the objects, wherein the pole and the receiving pockets have a rhombus profile, and wherein the rhombus profile of the receiving pocket that is laterally directed is oriented so that the pole received within the pocket has its corner side directed upwardly.

18. A modular barrier comprising at least two building blocks of claim 1, wherein adjacent building blocks are connected to each other.

19. The modular barrier as claimed in claim 18, further comprising a jack provided with wheels wherein the jack has two states, a first state in which the modular barrier is uploaded onto the wheels of the jack and a second state in which the wheels of the jack are neutralized.

20. The modular barrier as claimed in claim 19, wherein the transition between the first state and the second state is controlled by a lever.

21. A modular barrier comprising at least two building blocks of claim 1, comprising a connecting bracket having at least two receiving pockets wherein at least one of said at least two receiving pockets is laterally directed and at least one of said at least two receiving pockets is directed in a predetermined angle relative to the at least one of the receiving pockets that is laterally directed; and a plurality of poles, wherein at least one of the poles is configured to be received within the at least one of the receiving pockets that is laterally directed so that the at least one of the poles is substantially parallel to the ground and wherein at least one of the poles is configured to be received within one of the at least two receiving pockets that are directed in the predetermined angle so as to allow the modular barrier to stop the objects, wherein adjacent building blocks are connected to each other and wherein the modular barrier further comprising a jack provided with wheels wherein the jack has two states, a first state in which the modular barrier is uploaded onto the wheels of the jack and a second state in which the wheels of the jack are neutralized, wherein the transition between the first state and the second state is controlled by a lever, and wherein the jack passes through corresponding holes in the connecting brackets that are aligned and the wheels of the jack are provided between adjacent connecting brackets.

* * * * *